US011740004B2

(12) United States Patent
Swab et al.

(10) Patent No.: US 11,740,004 B2
(45) Date of Patent: Aug. 29, 2023

(54) TRANSPORTATION REFRIGERATION UNIT WITH ADAPTIVE DEFROST

(71) Applicant: Carrier Corporation, Palm Beach Gardens, FL (US)

(72) Inventors: Michael Thomas Swab, Acworth, GA (US); David C. Brondum, Cazenovia, NY (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 17/057,310

(22) PCT Filed: Jun. 9, 2020

(86) PCT No.: PCT/US2020/036811
§ 371 (c)(1),
(2) Date: Nov. 20, 2020

(87) PCT Pub. No.: WO2020/263560
PCT Pub. Date: Dec. 30, 2020

(65) Prior Publication Data

US 2022/0187007 A1 Jun. 16, 2022

Related U.S. Application Data

(60) Provisional application No. 62/867,054, filed on Jun. 26, 2019.

(51) Int. Cl.
*F25D 21/00* (2006.01)
*F25D 11/00* (2006.01)
(Continued)

(52) U.S. Cl.
CPC ..... *F25D 21/006* (2013.01); *F25D 11/003* (2013.01); *F25D 21/025* (2013.01); *F25D 21/125* (2013.01); *F25D 2700/00* (2013.01)

(58) Field of Classification Search
CPC .... F25D 21/006; F25D 11/003; F25D 21/025; F25D 21/125; F25D 2700/00; F25D 21/002; F25D 21/004
See application file for complete search history.

(56) References Cited

U.S. PATENT DOCUMENTS 2,975,611 A 3/1961 Pietsch
3,377,817 A 4/1968 Petranek
(Continued)

FOREIGN PATENT DOCUMENTS

AU 447376 B 6/1972
AU 488725 B 5/1975
(Continued)

OTHER PUBLICATIONS

International Search Report Application No. PCT/2020/036811; dated Sep. 11, 2020; pp. 5.
Written Opinion No. PCT/2020/036811; dated Sep. 11, 2020; pp. 9.

*Primary Examiner* — Jenna M Hopkins
(74) *Attorney, Agent, or Firm* — CANTOR COLBURN LLP

(57) ABSTRACT

A transport refrigeration unit (TRU) is provided. The TRU includes a housing defining a flow path from an intake to an outlet, a blower to drive air along the flow path from the intake to the outlet, coils disposed in the flow path between the intake and the outlet and over which the air driven by the blower flows, a defrost element to execute a defrost action with respect to the coils, sensing elements at the intake and the outlet to sense pressures of the air at the intake and the outlet and a controller. The controller is configured to control at least one of the blower and the defrost element in accordance with readings of the sensing elements.

18 Claims, 4 Drawing Sheets

(51) Int. Cl.
*F25D 21/02* (2006.01)
*F25D 21/12* (2006.01)

(56) References Cited

U.S. PATENT DOCUMENTS

| | | | | | |
|---|---|---|---|---|---|
| 3,653,223 | A | | 4/1972 | Jones et al. | |
| 3,689,610 | A | | 9/1972 | Nicholson | |
| 3,712,377 | A | | 1/1973 | Hill et al. | |
| 3,738,425 | A | | 6/1973 | Thompson | |
| 4,101,747 | A | | 7/1978 | Houk | |
| 4,694,657 | A | | 9/1987 | Vaughn | |
| 4,975,239 | A | | 12/1990 | O'Neil et al. | |
| 5,029,450 | A | * | 7/1991 | Takano | F25D 17/06 62/239 |
| 5,242,651 | A | | 9/1993 | Brayden et al. | |
| 5,682,410 | A | | 10/1997 | McGrady et al. | |
| 6,601,396 | B2 | | 8/2003 | Bair, III et al. | |
| 8,600,559 | B2 | | 12/2013 | Grohman et al. | |
| 10,563,900 | B2 | * | 2/2020 | Ferguson | F25D 21/004 |
| 11,002,475 | B1 | * | 5/2021 | Jackson | F25D 21/02 |
| 2017/0059227 | A1 | * | 3/2017 | Balakrishna | F25D 17/045 |
| 2019/0072310 | A1 | * | 3/2019 | Choi | F25D 17/08 |
| 2019/0285330 | A1 | * | 9/2019 | Ohlsson | F25B 47/022 |
| 2022/0187007 | A1 | * | 6/2022 | Swab | F25D 21/025 |

FOREIGN PATENT DOCUMENTS

| | | | | | |
|---|---|---|---|---|---|
| AU | 589655 | B | | 1/1987 | |
| AU | 2008263581 | B2 | | 1/2013 | |
| AU | 2009260995 | B2 | | 11/2015 | |
| AU | 2013338370 | B2 | | 6/2016 | |
| AU | 2013332258 | B2 | | 8/2017 | |
| AU | 2018241120 | A1 | | 10/2018 | |
| CA | 1060430 | A | | 8/1979 | |
| CA | 1263967 | A | | 12/1989 | |
| CA | 2134168 | C | | 5/1995 | |
| CA | 1339119 | C | | 7/1997 | |
| CA | 2354820 | A1 | | 2/2002 | |
| CA | 2424120 | A1 | | 4/2002 | |
| CA | 2449138 | A1 | | 12/2002 | |
| CA | 2473991 | A1 | | 8/2003 | |
| CA | 2931838 | A1 | | 2/2016 | |
| CA | 2994155 | A1 | | 2/2017 | |
| CA | 3009290 | A1 | | 7/2017 | |
| CA | 3006476 | A1 | | 12/2018 | |
| CN | 206478913 | | * | 8/2017 | B60H 1/32 |
| DE | 10200060881 | A1 | * | 3/2012 | B60H 1/2218 |
| EP | 0147825 | A2 | * | 12/1984 | |
| GB | 1131733 | A | | 10/1968 | |
| GB | 1359507 | A | | 7/1974 | |
| GB | 1426180 | A | | 2/1976 | |
| GB | 1462431 | A | | 1/1977 | |
| GB | 1556064 | A | | 11/1979 | |
| IN | 205771 | B | | 10/2003 | |
| JP | 2016118362 | A | * | 6/2016 | F25D 17/06 |
| KR | 101553204 | B1 | | 9/2015 | |
| WO | 03063868 | A1 | | 1/2003 | |
| WO | 2004066981 | A1 | | 8/2004 | |
| WO | 2012003202 | A2 | | 1/2012 | |
| WO | WO-2014088821 | A1 | * | 8/2015 | B60H 1/00264 |
| WO | 2018088839 | A1 | | 5/2018 | |

* cited by examiner

TRANSPORTATION REFRIGERATION UNIT WITH ADAPTIVE DEFROST

CROSS-REFERENCE TO RELATED APPLICATIONS

This application is a National Phase of PCT Application No. PCT/US2020/036811 filed Jun. 9, 2020 which claims the benefit of priority to Provisional Application No. 62/867,054 filed Jun. 26, 2019 the disclosure of which is incorporated herein by reference in its entirety.

BACKGROUND

The following description relates to transportation refrigeration units (TRUs) and, more specifically, to a TRU with an adaptive defrost capability.

In shipping and trucking industries, TRUs are installed on containers in order to condition the air inside the containers. The TRUs typically draw in air from the container interior and direct that air over thermal elements to either cool or, in some cases, heat the air before blowing the conditioned air back into the container interior. In the case of a TRU being used to cool the container interior, the TRU includes a flow path along which air to be cooled flows. This air enters the flow path through an inlet, flows over coils whereupon heat is removed from the air and exits through an outlet.

During the operation of a TRU being used to cool air, it is possible that certain events can occur which tend to degrade TRU performance. These include, but are not limited to, the coils becoming frosted and foreign objects and debris (FOD) entering into the inlet. In these or other cases, the air pressures in the flow path can increase and lead to lost efficiency and, if the FOD is flammable, there can be an increased risk of fire.

Currently, TRUs can include a switch element that trips when air pressures reach a certain level. At this point, a controller of the TRU typically assumes that the TRU is in a fully frosted coil condition and initiates a defrost mode. There is, however, no ability for the controller of the TRU to determine how frosted the coils actually are is, if the coils are clean at the end of the defrost mode and no way to detect if FOD has blocked the inlet located on a face of the evaporator. This can again lead to inefficient cooling as a full defrost mode might not need to have been run, which represents a lost efficiency cost, and/or to a situation in which the coils remain partially blocked following defrosting, which also represents a lost efficiency cost.

BRIEF DESCRIPTION

According to an aspect of the disclosure, a transport refrigeration unit (TRU) is provided. The TRU includes a housing defining a flow path from an intake to an outlet, a blower to drive air along the flow path from the intake to the outlet, coils disposed in the flow path between the intake and the outlet and over which the air driven by the blower flows, a defrost element to execute a defrost action with respect to the coils, sensing elements at the intake and the outlet to sense pressures of the air at the intake and the outlet and a controller. The controller is configured to control at least one of the blower and the defrost element in accordance with readings of the sensing elements.

In accordance with additional or alternative embodiments, the controller includes a memory unit in which baseline and pre-trip pressure information is stored, the baseline pressure information includes factory set baseline pressure readings of airflows along the flow path, the pre-trip pressure information includes pressure readings of airflows along the flow path taken prior to a transport event and the controller is configured to issue an error signal in an event the pre-trip pressure information deviates from the baseline pressure information by a predefined degree.

In accordance with additional or alternative embodiments, the controller is further configured to control the blower and the coils to execute TRU cooling cycles for cooling the air driven by the blower.

In accordance with additional or alternative embodiments, the controller monitors the readings of the sensing elements during the TRU cooling cycles and ceases the TRU cycles in an event the readings of the sensing elements suddenly change.

In accordance with additional or alternative embodiments, the controller operates the blower in reverse once the TRU cooling cycles are ceased.

In accordance with additional or alternative embodiments, the controller directs hot discharge gas toward the coils once the TRU cooling cycles are ceased.

In accordance with additional or alternative embodiments, the controller operates the defrost element once the TRU cooling cycles are ceased.

In accordance with additional or alternative embodiments, the controller monitors the readings of the sensing elements following completion of each TRU cycle and operates the defrost element in accordance with the readings of the sensing elements indicating changed pressures in the flow path, the controller operates the defrost element to execute a partial defrost mode in accordance with the readings of the sensing elements indicating slightly changed pressures in the flow path and the controller operates the defrost element to execute a full defrost mode in accordance with the readings of the sensing elements indicating substantially changed pressures in the flow path.

In accordance with additional or alternative embodiments, the defrost element includes local defrost elements disposed proximate to portions of the coils and the partial defrost mode includes activations of some of the local defrost elements.

According to another aspect of the disclosure, a method of operating a transport refrigeration unit (TRU) including coils, a blower to drive air over the coils and a defrost element to defrost the coils is provided. The method includes establishing baseline pressure information for the TRU with known blockage conditions, gathering current pressure information for the TRU during operational conditions, comparing the current pressure information with the baseline pressure information and controlling operations of at least one of the blower and the defrost element in accordance with results of the comparing.

In accordance with additional or alternative embodiments, the gathering includes pre-trip gathering of pre-trip current pressure information, the comparing includes comparing the pre-trip pressure information with the baseline pressure information and the method further includes issuing an error signal in an event the pre-trip current pressure information deviates from the baseline pressure information by a predefined degree.

In accordance with additional or alternative embodiments, the blower and the coils are controlled to execute TRU cooling cycles for cooling the air driven by the blower.

In accordance with additional or alternative embodiments, the method further includes ceasing execution of the TRU cooling cycles in an event the current pressure information suddenly changes.

In accordance with additional or alternative embodiments, the method further includes operating the blower in reverse once the execution of the TRU cooling cycles ceases.

In accordance with additional or alternative embodiments, the method further includes directing hot discharge gas toward the coils once the executing of the TRU cooling cycles ceases.

In accordance with additional or alternative embodiments, the method further includes operating the defrost element once the execution of the TRU cooling cycles ceases.

In accordance with additional or alternative embodiments, the comparing includes comparing the current pressure information with the baseline pressure information following each execution of each TRU cycle being completed, the controlling includes controlling operations of at least one of the blower and the defrost element in accordance with results of the comparing following each execution of each TRU cycle being completed, the controlling of the operations of the defrost element includes executing a partial defrost mode in accordance with the results of the comparing following each execution of each TRU cycle being completed indicating slightly changed pressures and the controlling of the operations of the defrost element includes executing a full defrost mode in accordance with the results of the comparing following each execution of each TRU cycle being completed indicating substantially changed pressures.

According to another aspect of the disclosure, a method of operating a transport refrigeration unit (TRU) including coils, a blower to drive air over the coils and a defrost element to defrost the coils is provided. The method includes establishing baseline pressure information for the TRU with known blockage conditions, controlling the blower and the coils to execute TRU cooling cycles for cooling the air driven by the blower, gathering current pressure information for the TRU during the TRU cooling cycles and following execution of each TRU cycle being completed, comparing the current pressure information with the baseline pressure information following each execution of each TRU cycle being completed and controlling the defrost element to execute partial or full defrost modes in accordance with the results of the comparing following each execution of each TRU cycle being completed indicating slightly or substantially changed pressures, respectively.

In accordance with additional or alternative embodiments, the gathering includes pre-trip gathering of pre-trip current pressure information, the comparing includes comparing the pre-trip pressure information with the baseline pressure information and the method further includes issuing an error signal in an event the pre-trip current pressure information deviates from the baseline pressure information by a predefined degree.

In accordance with additional or alternative embodiments, the method further includes ceasing execution of the TRU cooling cycles in an event the current pressure information suddenly changes and at least one of operating the blower in reverse once the execution of the TRU cooling cycles ceases, directing hot discharge gas toward the coils once the execution of the TRU cycles ceases and operating the defrost element once the execution of the TRU cooling cycles ceases.

These and other advantages and features will become more apparent from the following description taken in conjunction with the drawings.

BRIEF DESCRIPTION OF THE DRAWINGS

The subject matter, which is regarded as the disclosure, is particularly pointed out and distinctly claimed in the claims at the conclusion of the specification. The foregoing and other features and advantages of the disclosure are apparent from the following detailed description taken in conjunction with the accompanying drawings in which:

These and other advantages and features will become more apparent from the following description taken in conjunction with the drawings.

DETAILED DESCRIPTION

As will be described below, a TRU is provided and includes a differential pressure sensor monitoring the evaporator intake and the outlet of the TRU. A value for a baseline clean coil air pressure (i.e., air ΔP) is factory set and, at the start of each trip or pre-trip, the air ΔP is measured. If the measurement returns a value for air ΔP that is above a predetermined level based on the baseline value, an error is given to check the coils. During operations of the TRU, the air ΔP is monitored throughout the TRU cycles and, if a sudden change is detected and is indicative of FOD blocking coils, an error is given and the TRU can be shut down. Also, after each TRU cooling cycle, pressures are measured and, if needed, a short defrost can be initiated to clean ice from the coils. After each defrost, the pressures are re-measured to see if the coils are ice free. If not, additional defrosts can be executed.

Figure 1:
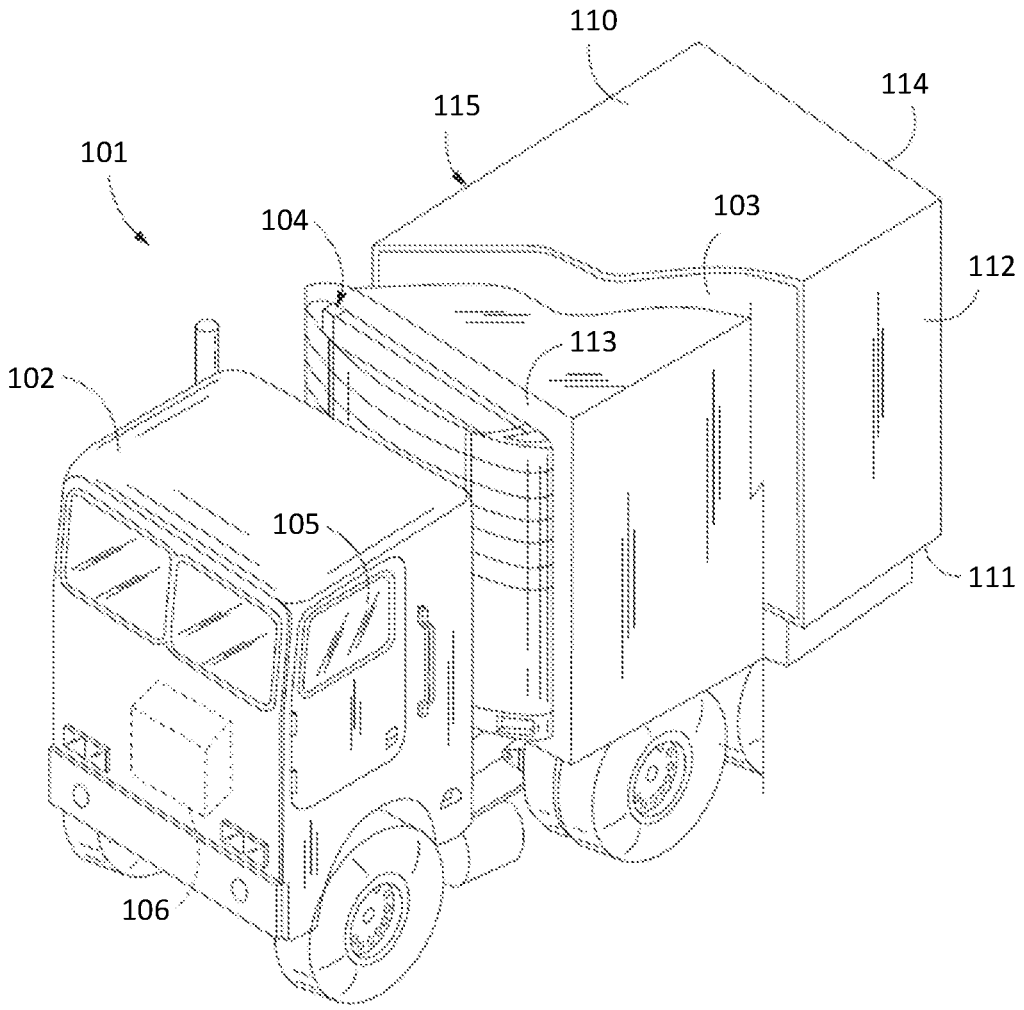
FIG. 1 is a perspective view of a transport vehicle in accordance with embodiments.

With reference to FIG. 1, a transport system 101 is illustrated and includes a tractor or vehicle 102, a conditioned space 103 that is pulled by the vehicle 102 and a refrigeration system 104 that conditions the air within the conditioned space 103.

While the transport system 101 is described herein as being a conditioned space 103 pulled by vehicle 102, it is to be understood that embodiments exist in which the conditioned space 103 is shipped by rail, sea or air or may be provided within any suitable container where the vehicle 102 is a truck, train, boat, airplane, helicopter, etc.

The vehicle 102 may include an operator's compartment or cab 105 and a vehicle motor 106. The vehicle 102 may be driven by a driver located within the cab, driven by a driver remotely, driven autonomously, driven semi-autonomously or any combination thereof. The vehicle motor 106 may be an electric or combustion engine powered by a combustible fuel. The vehicle motor 106 may also be part of the power train or drive system of a trailer system, thus the vehicle motor 106 is configured to propel the wheels of the vehicle 102 and/or the wheels of the conditioned space 103. The vehicle motor 106 may be mechanically connected to the wheels of the vehicle 102 and/or the wheels of the conditioned space 103.

The conditioned space 103 may be coupled to the vehicle 102 and is thus pulled or propelled to desired destinations.

The conditioned space 102 may include a top wall 110, a bottom wall 111 opposed to and spaced from the top wall 110, two side walls 112 spaced from and opposed to one-another and opposing front and rear walls 113 and 114 with the front wall 113 being closest to the vehicle 102. The conditioned space 103 may further include doors (not shown) at the rear wall 114 or any other wall. The top, bottom, side and front and back walls 110, 111, 112 and 113 and 114 together define the boundaries of a refrigerated interior volume 115. The refrigeration system 104 is configured to condition the refrigerated interior volume 115.

Figure 2:
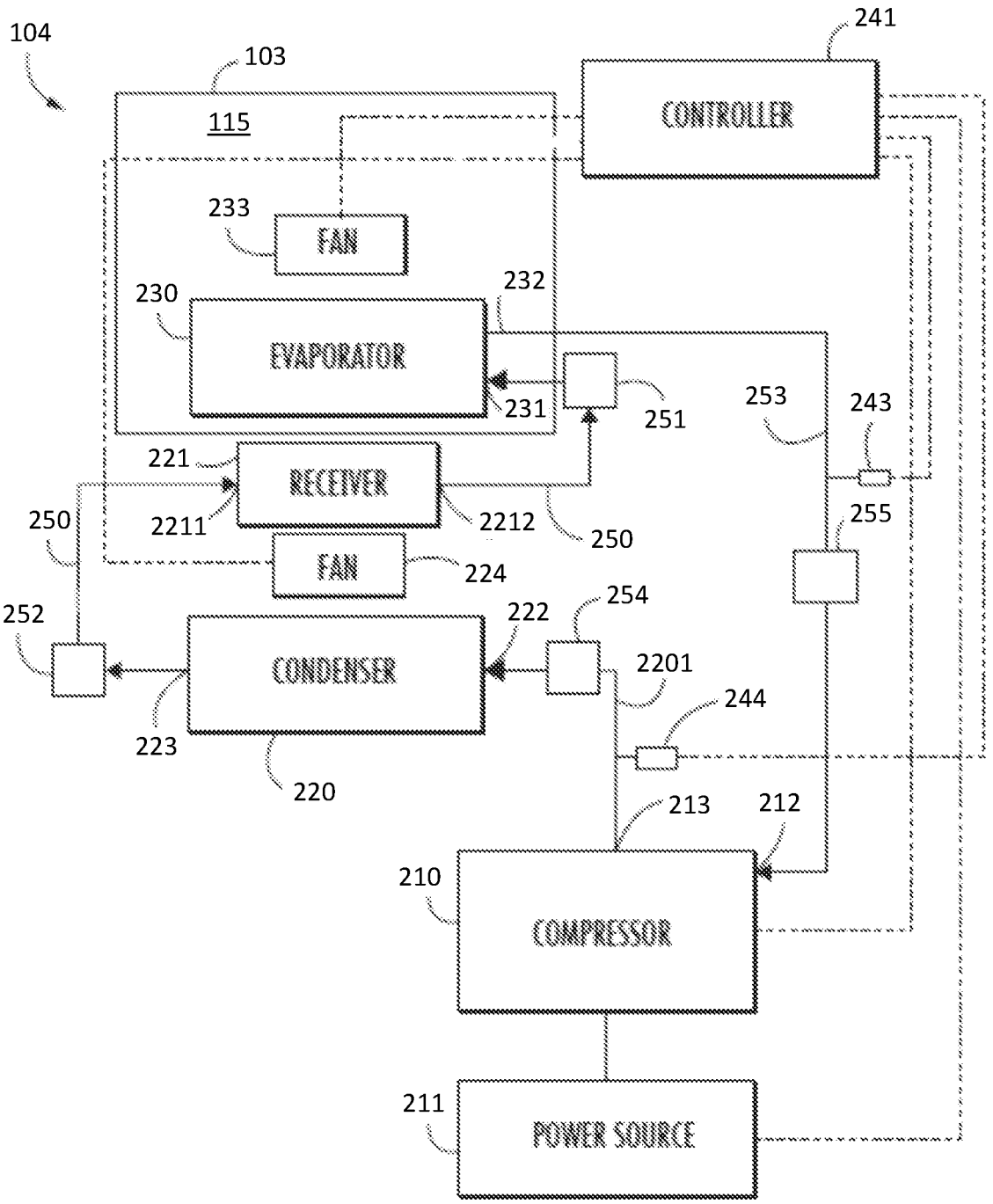
FIG. 2 is a schematic diagram of a refrigeration system of the transport vehicle of FIG. 1 in accordance with embodiments.

With reference to FIG. 2, the conditioned space 103 may be provided as an interior of a refrigerated trailer, a refrigerated truck, a refrigerated space or a refrigerated container with the refrigeration system 104 adapted to operate using a refrigerant such as a low GWP refrigerant such as A1, A2, A2L, A3, etc. An evaporator 230, a portion of a refrigerant line 253 proximate an evaporator outlet 232 and a portion of a refrigerant line 250 proximate an evaporator inlet 231 may be located within the refrigerated interior volume 115 of the conditioned space 103.

The refrigeration system 104 may be a transport refrigeration system such as a transportation refrigeration unit (TRU). The refrigeration system 104 includes a compressor 210, a condenser 220 and an evaporator 230 and a controller 241.

The compressor 210 is powered by or driven by a power source 211. The compressor 210 receives refrigerant through a compressor inlet 212 from the evaporator 230 and discharges refrigerant through a compressor outlet 213 to the condenser 220 through a receiver 221. The condenser 220 receives a hot gas flow of refrigerant from the compressor 210 through a condenser inlet 222 and discharges a fluid flow of refrigerant through a condenser outlet 223 to the receiver 221. The condenser inlet 222 is fluidly connected to the compressor outlet 213 through a refrigerant line 2201. A fan, such as a condenser fan 224, may be associated with and disposed proximate to the condenser 220.

The evaporator 230 is arranged to receive a fluid flow of refrigerant from the condenser 220 through an evaporator inlet 231 and is arranged to discharge a fluid flow of refrigerant to the compressor 210 through an evaporator outlet 232. The evaporator inlet 231 is fluidly connected to the condenser outlet 223 through the receiver 221 via a refrigerant line 250 through a first valve 251 and/or a second valve 252 that is disposed on an opposite side of the receiver 221 than the first valve 251. The evaporator outlet 232 is fluidly connected to the compressor inlet 212 through a refrigerant line 253. A fan such as an evaporator fan 233 may be associated with and disposed proximate to the evaporator 230.

The first valve 251 may be an expansion valve such as an electronic expansion valve, a movable valve or a thermal expansion valve. The first valve 251 is movable between an open position and a closed position to selectively inhibit and facilitate a fluid flow of refrigerant between the evaporator 230 and at least one of the condenser 220 and the receiver 221. The open position facilitates a fluid flow of refrigerant between the evaporator inlet 231 and the condenser outlet 223 through the receiver 221. The closed position inhibits a fluid flow of refrigerant between the evaporator inlet 231 and the condenser outlet 223 through the receiver 221 as well as inhibits a fluid flow of refrigerant between the receiver 221 and the evaporator inlet 231.

The receiver 221 is fluidly connected to the condenser 220 and the evaporator 230 and is arranged to receive and store refrigerant based on a position of at least one of the first valve 251 and/or the second valve 252. The receiver 221 is arranged to receive refrigerant from the condenser outlet 223 through a receiver inlet 2211 via the refrigerant line 250. In at least one embodiment, the second valve 252 is arranged to selectively facilitate a fluid flow between the condenser outlet 223 and the receiver inlet 2211. The second valve 252 may be a movable valve, a solenoid valve, a liquid service valve, a thermal expansion valve or an electronic expansion valve and is movable between open and closed positions to facilitate or impede a fluid flow of refrigerant between the condenser outlet 223 and the first receiver inlet 2211. The receiver 221 is arranged to discharge or provide a fluid flow of refrigerant through a receiver outlet 2212 to the evaporator inlet 231 via the first valve 251 through the refrigerant line 250.

A third valve 254 may be arranged to selectively facilitate a fluid or hot gas flow between the compressor outlet 213 and the condenser inlet 222. The third valve 254 may be a movable valve, check valve, a liquid service valve, a thermal expansion valve, or an electronic expansion valve and is movable between open and closed positions to facilitate or impede a fluid or hot gas flow of refrigerant between the compressor outlet 213 and the condenser inlet 222.

A fourth valve 255 may be arranged to selectively facilitate a fluid flow between the evaporator outlet 232 and the compressor inlet 212. The fourth valve 255 may be a movable valve, check valve, a liquid service valve, a thermal expansion valve, or an electronic expansion valve and is movable between open and closed positions to facilitate or impede a fluid flow of refrigerant between the evaporator outlet 232 and the compressor inlet 212.

The controller 241 is provided with input communication channels that are arranged to receive information, data, or signals from, for example, the compressor 210, the power source 211, the condenser fan 224, the first valve 251, the evaporator fan 233, the second valve 252, a pressure sensor 243 and a compressor discharge pressure sensor 244. The controller 241 is provided with output communication channels that are arranged to provide commands, signals, or data to, for example, the compressor 210, the power source 211, the condenser fan 224, the first valve 251, the evaporator fan 233 and the second valve 252. The controller 241 can be provided with at least one processor that is programmed to execute various operations based on information, data or signals provided via the input communication channels and to output commands via the output communication channels. Further details of the controller 241 will be provided below.

While the refrigeration system 104 has been described in accordance with embodiments herein, it is to be understood that other embodiments of the refrigeration system 104 and that other conditioning systems exist and that the following description is relevant to each of these various embodiments and systems.

Figure 3:
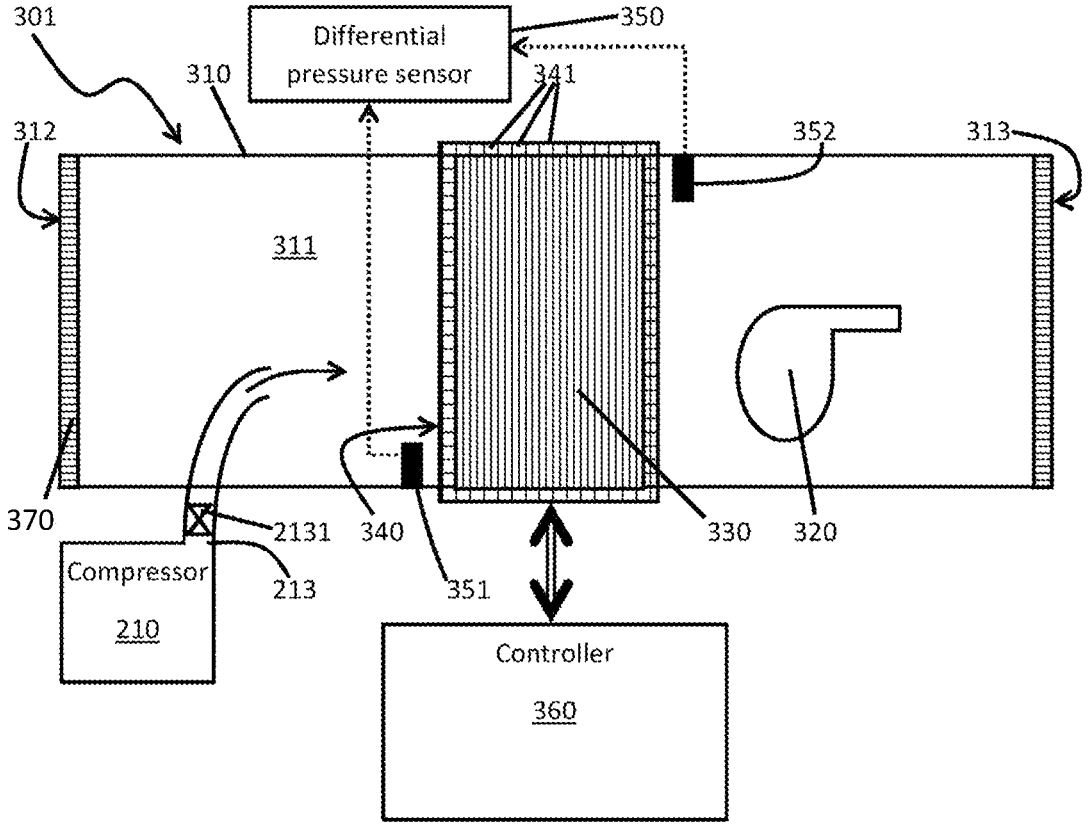
FIG. 3 is a schematic diagram of a transport refrigeration unit (TRU) in accordance with embodiments.

With reference to FIG. 3, a TRU 301 is provided for use in the refrigeration system 104 as described above, for example. In addition to the feature described above, the TRU 301 includes a housing 310 that is formed to define a flow path 311 from an intake 312 to an outlet 313 (that leads to the refrigerated interior volume 115), a blower 320 to drive air along the flow path 311 from the intake 312 to the outlet 313, coils 330 disposed in the flow path 311 between the intake 312 and the outlet 313 and over which the air driven by the blower 320 flows and a defrost element 340 to execute a defrost action with respect to the coils 330. The TRU 301 further includes a differential pressure sensor 350 for each evaporator and a controller 360. The differential pressure sensor 350 has a port 351 on the intake side of the coils 330 and a port 352 on the discharge or outlet side of the coils 330 to thus sense pressures of the air at the intake 312 and the outlet 313. The controller 360 can be a component of the controller 241 described above and is coupled to the differential pressure sensor 350 (and indirectly to the ports 351 and 352), the blower 320 and the defrost element 340. The controller 360 is configured to control at least one of the blower 320 and the defrost element 340 in accordance with readings of the differential pressure sensor 350.

It is to be understood that, while the TRU 301 is described herein with a differential pressure sensor for each evaporator, other embodiments exist. For example, in a case in which a TRU has multiple local or remote evaporators, the TRU can have multiple differential pressure sensors respectively associated with corresponding ones of the multiple local or remote evaporators. The multiple differential pressure sensors can be positioned in various positions throughout the TRU 301 and the ports for each of the multiple differential pressure sensors can similarly be positioned in various positions throughout the TRU 301. As another example, multiple sensors of a single port type can be used to determine a differential pressure where the multiple sensors are disposed on opposite sides of the coils 330. The following description will, however, relate only to the case of the TRU 301 including a single differential pressure sensor 350 with ports 351 and 352 (the differential pressure sensor 350 and the ports 351 and 352 are also referred to herein as "sensing elements") for a single evaporator for purposes of clarity and brevity.

One or both of the intake 312 and the outlet 313 can include a grating 370. In the case of the intake 312, the grating 370 can be disposed to prevent or inhibit FOD from entering into the intake 312 and landing on the coils 330. It is to be understood, however, that the grating 370 allows for air to flow through the intake 312 and thus cannot entirely prevent FOD from entering into the intake 312.

The defrost element 340 can include local defrost elements 341 that are proximate to sections 331 of the coils 330. These local defrost elements 341 can be provided as heating elements and can be operated as a unit to heat and thus defrost the entirety of the coils 330 (i.e., the full defrost mode) or independently to heat and thus defrost the corresponding sections 331 of the coils 330 (i.e., the partial defrost mode).

In accordance with embodiments, the defrost element 340 or the local defrost elements 341 can include or be provided as features that are capable of heating the coils 330 or the corresponding sections 331 of the coils 330 using resistive heating and/or by blowing relatively high-temperature gases toward and over the coils 330 or the corresponding sections 331 of the coils 330.

In accordance with further embodiments, it is also possible for hot discharge gas to be directed or bypassed from the compressor 210 or from the compressor outlet 213 of the compressor 210 (see FIG. 2) using a valve 2131 or another suitable feature disposed in or downstream from the compressor outlet 213 and this hot discharge gas can be sent through the coils 330 to facilitate defrost. In these or other cases, the flow of the hot discharge gas can be re-directed between the coils 330 and the outlet 313 so as to avoid blowing water or other matter onto cargo or other undesirable effects in the refrigerated interior volume 115.

Figure 4:
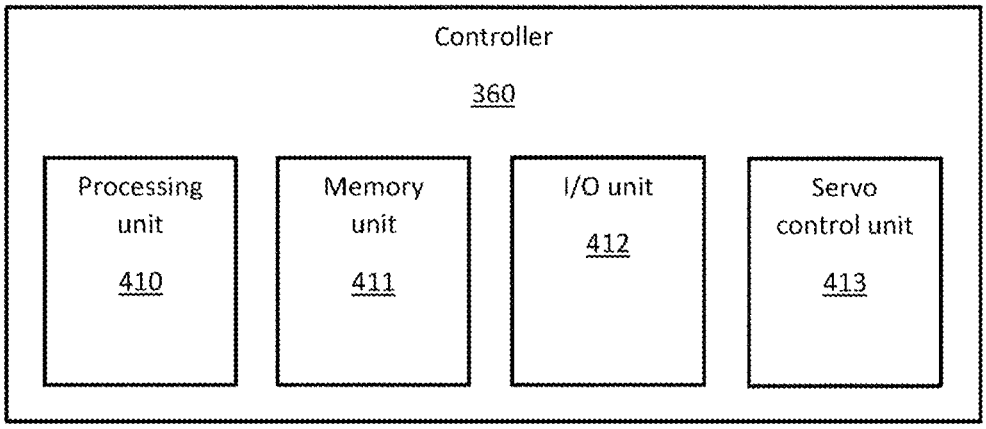
FIG. 4 is a schematic diagram of a controller of the TRU of FIG. 3 in accordance with embodiments.

With reference to FIG. 4, the controller 360 can include a processing unit 410, a memory unit 411, an input/output (I/O) unit 412 by which the processing unit 410 is communicative with the differential pressure sensor 350, the blower 320 and the defrost element 340 and a servo control unit 413 by which the processing unit 410 can control operations of the blower 320, the coils 330 and the defrost element 340 (or the local defrost elements 341 as a unit or independently of one another). The memory unit 411 has executable instructions and pressure information stored thereof. The executable instructions are readable and executable by the processing unit 410 and, when the executable instructions are read and executed by the processing unit 410, the executable instructions cause the processing unit 410 to operate as described herein. The pressure information can include baseline pressure information of the TRU 301 and pre-trip pressure information of the TRU 301.

Figure 5:
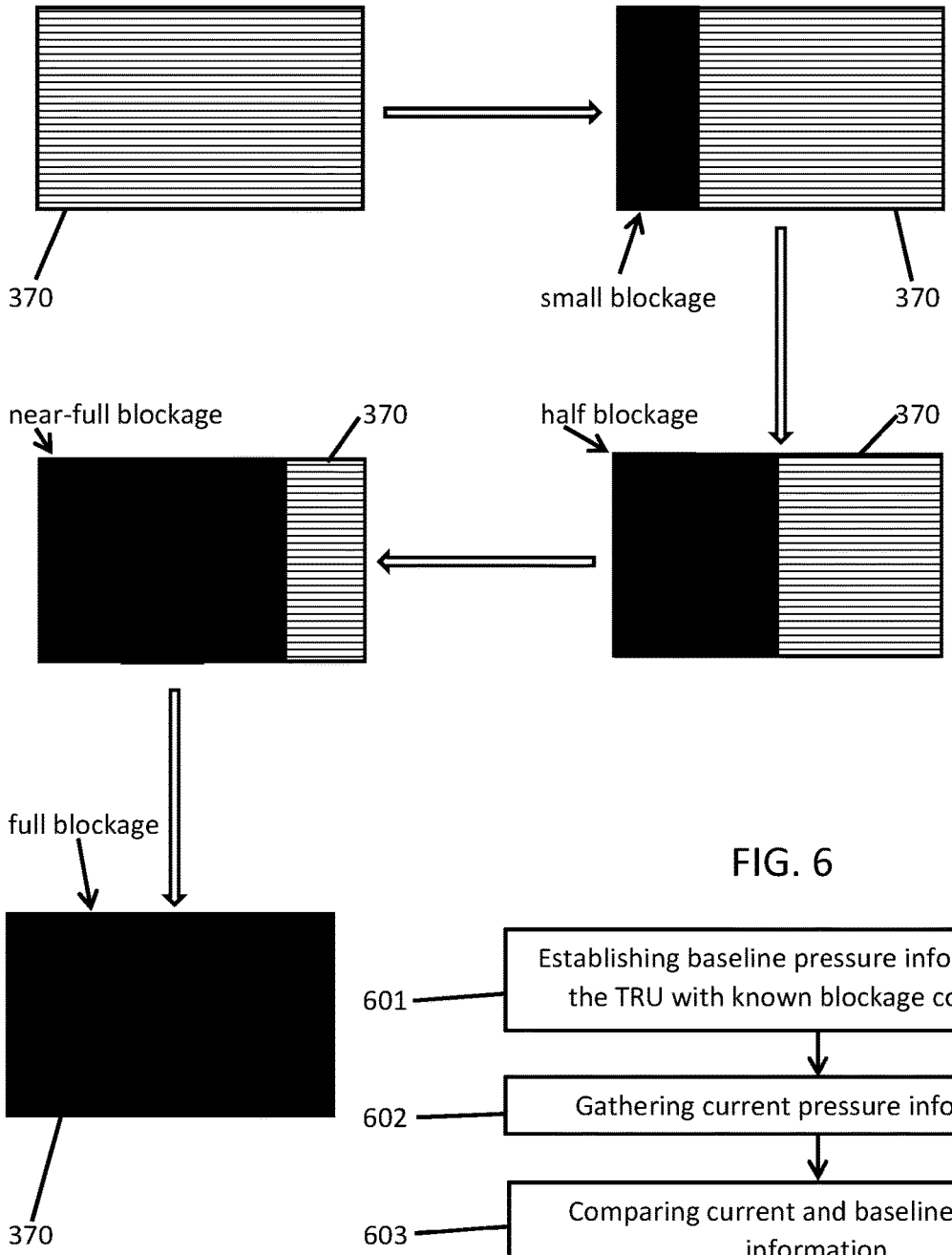
FIG. 5 is an illustration of an operation of collecting baseline pressure information in accordance with embodiments.

With reference back to FIGS. 3 and 4 and with additional reference to FIG. 5, the baseline pressure information of the TRU 301 can be factory set. In an exemplary case, the baseline pressure information can be generated by flowing air through the TRU 301, blocking increasingly large sections of the grating 370 to mimic various frosted coil conditions or FOD ingress and recording pressure changes in the flow path 311 as read by the differential pressure sensor 350.

During pre-trip operations, the processing unit 410 can read and execute the executable instructions whereupon the executable instructions cause the processing unit 410 to operate as follows. The processing unit 410 can generate commands to operate the blower 320 and can issue those commands to the servo control unit 413 whereupon the servo control unit 320 runs the blower 320. At this point, the processing unit 410 can be receptive of readings of pre-trip pressure information from the differential pressure sensor 350 and can compare those readings with the baseline pressure information. In an event the readings deviate from the baseline pressure information by a predefined degree, the processing unit 410 can generate and issue an error signal (i.e., to prompt an operator to check the oil of the TRU or to do other maintenance).

During trip operations, the processing unit 410 can read and execute the executable instructions whereupon the executable instructions cause the processing unit 410 to operate as follows. The processing unit 410 can generate commands to operate the blower 320 and the coils 330 to execute TRU cycles for cooling the air driven by the blower 320 and can issue those commands to the servo control unit 413 whereupon the servo control unit 320 runs the blower 320 and the coils 330. The processing unit 410 can be receptive of readings of current pressure information from the differential pressure sensor 350 and can monitor the readings by comparing the readings with one or more of the baseline pressure information, the pre-trip pressure information and recent readings.

In an event the readings suddenly change as an indication of FOD ingress, the processing unit 410 can generate commands to cease executions of the TRU cycles whereupon the servo control unit 320 stops the blower 320 and the coils 330. In addition, once the TRU cycles are ceased, the processing unit 410 can generate commands to operate the blower 320 in reverse, to direct hot discharge gas from the compressor 210 or the compressor outlet 213 of the compressor 210 toward the coils 330 (i.e., by controlling the valve 2131) and/or to operate the defrost element 340. The servo control unit 413 complies with one or more of these commands.

The processing unit 410 can continue to be receptive of and to monitor the readings of the differential pressure sensor 350 following completion of each TRU cycle and can generate commands to operate the defrost element 340 in accordance with the readings of the differential pressure sensor 350 indicating changed pressures in the flow path 311 which the servo control unit 413 complies with. That is, the processing unit 410 can effectively operate the defrost element 340 (i.e., the local defrost elements 341 independently) to execute a partial defrost mode in accordance with the readings of the differential pressure sensor 350 indicating slightly increased pressures or first changed pressures in the flow path 311 (i.e., pressures consistent with a partial blockage of the grating 370 as shown in FIG. 4). Conversely, the processing unit 410 can effectively operate the defrost element 340 as a unit to execute a full defrost mode in accordance with the readings of the differential pressure sensor 350 indicating substantially increased pressures or second changed pressures of a greater magnitude than the first changed pressures in the flow path 311 (i.e., pressures consistent with a full blockage of the grating 370 as shown in FIG. 4).

Figure 6:
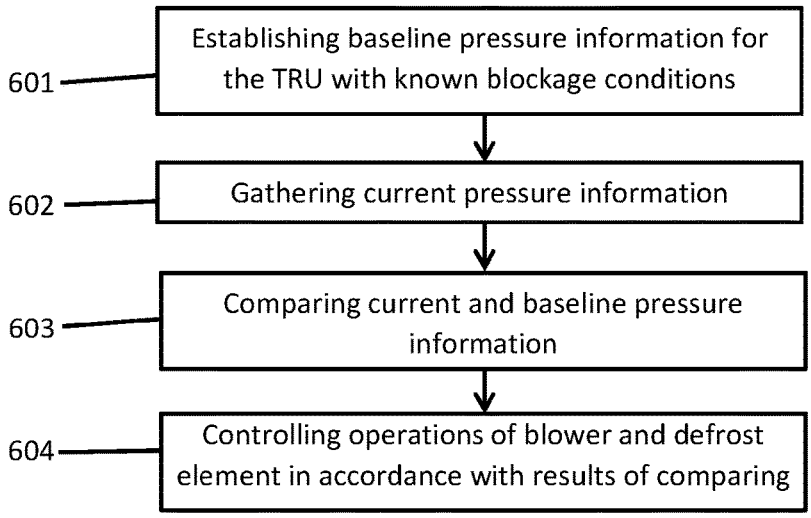
FIG. 6 is a flow diagram illustrating a method of operation a transport refrigeration unit (TRU) in accordance with embodiments.

With reference to FIG. 6, a method of operating the TRU 301 is provided. As shown in FIG. 6, the method includes establishing baseline pressure information for the TRU with known blockage conditions (601), gathering current pressure information for the TRU during operational conditions (602), comparing the current pressure information with the baseline pressure information (603) and controlling operations of at least one of the blower and the defrost element in accordance with results of the comparing (604).

Technical effects and benefits of the enclosure design of the present disclosure are the provision of TRUs with improved fire safety capabilities and cooling performance. Additional advantages can be fuel savings and the availability of hard data when discussing with customers why they had a cooling issue or a thermal event.

While the disclosure is provided in detail in connection with only a limited number of embodiments, it should be readily understood that the disclosure is not limited to such disclosed embodiments. Rather, the disclosure can be modified to incorporate any number of variations, alterations, substitutions or equivalent arrangements not heretofore described, but which are commensurate with the spirit and scope of the disclosure. Additionally, while various embodiments of the disclosure have been described, it is to be understood that the exemplary embodiment(s) may include only some of the described exemplary aspects. Accordingly, the disclosure is not to be seen as limited by the foregoing description, but is only limited by the scope of the appended claims.

What is claimed is:

1. A transport refrigeration unit (TRU), comprising:

a housing defining a flow path from an intake to an outlet;

a blower to drive ai along the flow path from the intake to the outlet;

coils disposed in the flow path between the intake and the outlet and over which the air driven by the blower flows;

a heater to execute a defrost action with respect to the coils;

sensing elements at the intake upstream from the coils and the outlet downstream from the coils to sense pressures of the air at the intake and the outlet; and a controller configured to control at least one of the blower and the heater in accordance with readings of the sensing elements, wherein:

the controller comprises a memory unit in which baseline and pre-trip pressure information is stored, the baseline pressure information comprises factory set baseline pressure readings of airflows along the flow path, the baseline pressure information being established for the TRU with known blockage conditions by a process comprising:

flowing air along the flow path through the TRU;

blocking increasingly large sections of the intake to mimic various frosted coil conditions or foreign object ingress; and recording pressure changes in the flow path at the intake upstream from the coils and at the outlet downstream from the coils, the pre-trip pressure information comprises pressure readings of airflows along the flow path taken prior to a transport event, and the controller is configured to issue an error signal in an event the pre-trip pressure information deviates from the baseline pressure information by a predefined degree.

2. The TRU according to claim 1, wherein the controller is further configured to control the blower and the coils to execute TRU cooling cycles for cooling the air driven by the blower.

3. The TRU according to claim 2, wherein the controller monitors the readings of the sensing elements during the TRU cooling cycles and ceases the TRU cycles in an event the readings of the sensing elements suddenly change.

4. The TRU according to claim 3, wherein the controller operates the blower in reverse once the TRU cooling cycles are ceased.

5. The TRU according to claim 3, wherein the controller directs hot discharge gas toward the coils once the TRU cooling cycles are ceased.

6. The TRU according to claim 3, wherein the controller operates the heater once the TRU cooling cycles are ceased.

7. The TRU according to claim 2, wherein:

the controller monitors the readings of the sensing elements following completion of each TRU cycle and operates the heater in accordance with the readings of the sensing elements indicating changed pressure in the flow path, the controller operates the heater to execute a partial defrost mode in accordance with the readings of the sensing elements indicating first changed pressures in the flow path, and the controller operates the heater to execute a full defrost mode in accordance with the readings of the sensing elements indicating second changed pressures of greater magnitude than the first change pressures in the flow path.

8. The TRU according to claim 7, wherein:

the heater comprises local heaters disposed proximate to portions of the coils, and the partial defrost mode comprises activation of some of the local heaters.

9. A method of operating a transport refrigeration unit (TRU) comprising coils, a blower to drive air over the coils and a heater to defrost the coils, the method comprising:

establishing baseline pressure information for the TRU with known blockage conditions;

gathering current pressure information for the TRU at an intake upstream from the coils and at an outlet downstream from the coils during operational conditions;

comparing the current pressure information with the baseline pressure information; and controlling operations of at least one of the blower and the heater in accordance with the results of the comparing, wherein:

the gathering comprises pre-trip gathering of pre-trip current pressure information, the comparing comprises comparing the pre-trip pressure information with the baseline pressure information, the baseline pressure information being established for the TRU with known blockage conditions by a process comprising:

flowing air along the flow path through the TRU;

blocking increasingly large sections of the intake to mimic various frosted coil conditions or foreign object ingress; and recording pressure changes in the flow path at the intake upstream from the coils and at the outlet downstream from the coil, and the method further comprising issuing an error signal in an event the pre-trip current pressure information deviates from the baseline pressure information by a predefined degree.

10. The method according to claim 9, wherein the blower and the coils are controlled to execute TRU cooling cycles for cooling the air driven by the blower.

11. The method according to claim 10, further comprising ceasing execution of the TRU cooling cycles in an event the current pressure information suddenly changes.

12. The method according to claim 11, further comprising operating the blower in reverse once the execution of the TRU cooling cycles ceases.

13. The method according to claim 11, further comprising directing hot discharge gas toward the coils once the executing of the TRU cooling cycles ceases.

14. The method according to claim 11, further comprising operating the heater once the execution of the TRU cooling cycles ceases.

15. The method according to claim 10, wherein:

the comparing comprises comparing the current pressure information with the baseline pressure information following each execution of each TRU cycle being completed, the controlling comprises controlling operations of at least one of the blower and the heater in accordance with results of the comparing following each execution of each TRU cycle being completed, the controlling of the operations of the heater comprises executing a partial defrost mode in accordance with the results of the comparing following each execution of each TRU cycle being completed indicating first changed pressures, and the controlling of the operations of the heater comprises executing a full defrost mode in accordance with the results of the comparing following each execution of each TRU cycle being completed indicating second changed pressures of greater magnitude than the first changed pressures.

16. A method of operating a transport refrigeration unit (TRU) comprising coils, a blower to drive air over the coils and a heater to defrost the coils, the method comprising:

establishing baseline pressure information for the TRU with known blockage conditions;

controlling the blower and the coils to execute TRU cooling cycles for cooling the air driven by the blower;

gathering current pressure information for a flow path of the TRU along which the coils are disposed at an intake upstream from the coils and at an outlet downstream from the coils during the TRU cooling cycles and following executions of each TRU cycle being completed;

comparing the current pressure information with the baseline pressure information following each execution of each TRU cycle being completed; and controlling the heater to execute partial or full defrost modes in accordance with the results of the comparing following each execution of each TRU cycle being completed indicating changed pressures, respectively, wherein the establishing of the baseline pressure information for the TRU with the known blockage conditions comprises:

flowing air along the flow path through the TRU;

blocking increasingly large sections of the intake to mimic various frosted coil conditions or foreign object ingress; and recording pressure changes in the flow path at the intake upstream from the coils and at the outlet downstream from the coils.

17. The method according to claim 16, wherein:

the gathering comprises pre-trip gathering of pre-trip current pressure information, the comparing comprises comparing the pre-trip pressure information with the baseline pressure information, and the method further comprises issuing an error signal in an event the pre-trip current pressure information deviates from the baseline pressure information by a predefined degree.

18. The method according to claim 16, further comprising:

ceasing execution of the TRU cooling cycles in an event the current pressure information suddenly changes; and at least one of:

operating the blower in reverse once the execution of the TRU cooling cycles ceases;

directing hot discharge gas toward the coils once the execution of the TRU cycles ceases; and operating the heater once the execution of the TRU cooling cycles ceases.

* * * * *